US006584705B2

(12) United States Patent
Lain

(10) Patent No.: US 6,584,705 B2
(45) Date of Patent: Jul. 1, 2003

(54) SHOE HAVING SIMPLIFIED CONSTRUCTION

(76) Inventor: Cheng Kung Lain, 2092 14th Ave., San Francisco, CA (US) 94116

( * ) Notice: Subject to any disclaimer, the term of this patent is extended or adjusted under 35 U.S.C. 154(b) by 0 days.

(21) Appl. No.: 09/836,701

(22) Filed: Apr. 17, 2001

(65) Prior Publication Data

US 2002/0148139 A1 Oct. 17, 2002

(51) Int. Cl.[7] ..... A43C 13/08

(52) U.S. Cl. ..... 36/14; 36/17 A; 36/22 R; 36/68; 12/142 A

(58) Field of Search ..... 36/14, 17 A, 22 R, 36/68, 18, 22 A, 17 R, 17 PW; 12/142 A

(56) References Cited

U.S. PATENT DOCUMENTS 1,136,799 A * 4/1915 Harris ..... 36/17 R
2,275,574 A * 3/1942 Vizard ..... 12/146 W
3,046,680 A * 7/1962 Hill et al. ..... 36/17 R
3,431,570 A * 3/1969 Murphy ..... 12/142 D
3,602,931 A * 9/1971 MacArthur et al. ..... 12/146 D
3,851,411 A * 12/1974 Crosbie et al. ..... 36/68
6,279,251 B1 * 8/2001 Davis ..... 36/68

* cited by examiner

*Primary Examiner*—Ted Kavanaugh
(74) *Attorney, Agent, or Firm*—John S. Christopher

(57) ABSTRACT

A shoe having a simplified construction includes an upper layer having a top edge and a bottom edge for enclosing a foot. An inner lining layer is joined to the top edge of the upper layer for providing comfort. A counter component is positioned between the upper layer and the inner lining layer for supporting a heel of the shoe. An outsole wall having a slanted inner surface for forming a cavity therein is joined to the bottom edge of the upper layer. An insole for supporting the foot is shaped to include a slanted outer surface for fitting within the cavity formed within the outsole wall. An outsole is joined to a bottom of the outsole wall and the insole for contacting the ground. In an alternative embodiment, the outsole wall includes a vertical inner surface for forming a rectangular-shaped cavity which accommodates a rectangular midsole filler layer.

13 Claims, 3 Drawing Sheets

FIG. 1
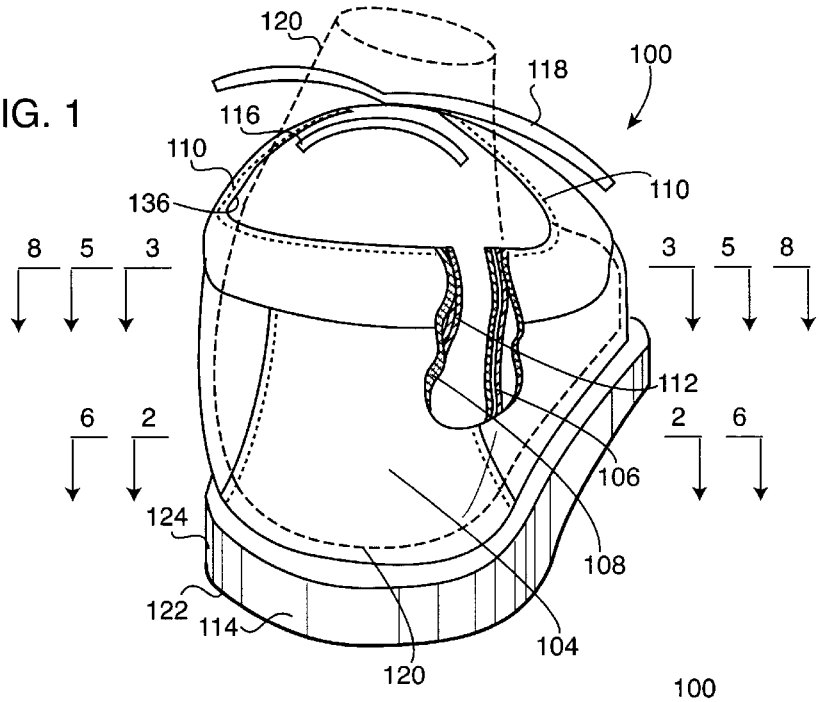
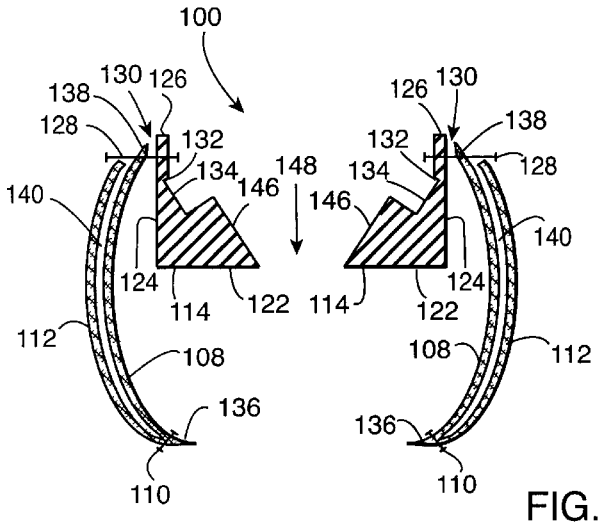
FIG. 2
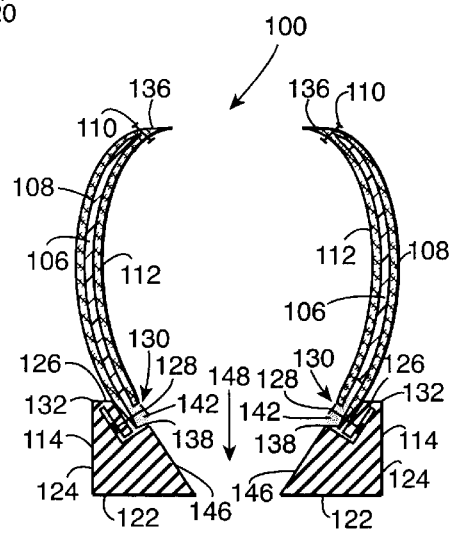
FIG. 3
FIG. 4
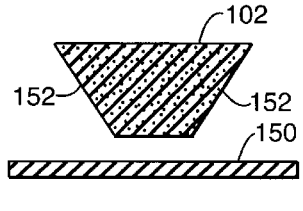

SHOE HAVING SIMPLIFIED CONSTRUCTION

BACKGROUND OF THE INVENTION

1. Technical Field

The present invention relates to shoe construction. More specifically, the present invention relates to methods and apparatus for a shoe having a simplified construction for providing improved waterproofing capability of the shoe, a rigid counter component for keeping the heel portion firm, and for providing support to the heel of the foot and shape to the shoe, cushioning that provides both shock absorption and stability, and for eliminating insole breakdown, reducing manufacturing cost and improving efficiency.

2. Background Art

The relevant prior art is directed to methods and apparatus for constructing shoes, including the heel portion of a shoe that comprises the interface between the upper leather portion and counter component with the outsole.

There are many methods known in the prior art for constructing shoes including dress, casual and athletic shoes. Most shoes include an upper leather portion and an inner lining that cover the top of the foot, a counter placed between the upper leather portion and the lining to provide rigidity at the heel, an insole upon which the foot rests, an outsole which contacts the ground surface and possibly a filler portion that is positioned between the insole and outsole. These specific terms and others typically used in conventional or traditional shoe construction whether the shoe is stitched or glued will now be defined. The term "upper leather portion or layer" refers to the visibly perceivable upper external portion of the shoe. The "inside lining" refers to a fabric layer employed for supporting the counter component, reinforcing the upper leather portion, and providing comfort to the foot. The "counter component" refers to a piece of plastic sheet positioned between the upper leather portion and the inside fabric lining in the heel region of the shoe. The function of the "counter component" is to keep the heel firm, support the foot, and provide shape to the shoe. The "midsole" refers to a piece of material such as rubber or leather that is glued to the inside fabric lining, upper leather portion, and the counter component to hold the construction together. The "filler" refers to a material the serves to fill a space formed between the midsole and the outsole when the midsole is glued to the inside lining, upper leather portion and the counter component. The "filler" which is glued in position can be comprised of the same material as the midsole or to the chemical compound ethylene vinyl acetate often referred to as "EVA". The "outsole" refers to the bottom portion of the shoe that contacts the ground or floor surface which can be comprised of leather, rubber or any of several suitable synthetic materials. The outsole is typically glued to the "filler". The "forepart" refers to that portion of the shoe or sole forward of the heel. The "last" refers to a form or mold which simulates the shape of a foot and which is employed to shape and size a shoe.

One of the several methods of shoe construction known in the art is referred to as the side stitch method. In the side stitch method, the upper leather portion, inner lining and counter components of the shoe and the outsole are machine stitched together along a side interface thereof. In some cases, cement may also be used to help secure the insole and inner lining to the outsole. After joining the upper leather portion and the outsole, the stitching remains visible along the side of the shoe. The side stitch method of shoe construction is often employed in outdoorsman and workman type shoes. A second method of shoe construction includes exclusively a cementing process (i.e., no stitching) in which the bottom of the upper leather portion and the outsole of the shoe are machine glued and pressed together. Typically, the upper leather and inner lining layers (and possibly a filler layer) are cemented between an insole and an outsole. The cementing method of shoe construction is commonly utilized for athletic footwear.

A third method of shoe construction known in the prior art is the "slip lasted" method. In the "slip lasted" method, the upper leather portion and the outsole are vertically machine stitched together all the way around the shoe. The outsole may have vertical slots formed in the bottom thereof so that the vertical stitching can pass through the upper leather portion and through that portion of the outsole positioned above the vertical slots. The "slip lasted" method is often used for oil tan leather shoes (such as moccasins) which cannot be glued because of the oil tan treatment applied to the leather.

A fourth method of shoe construction is identified as the "stitch and turn" method. In the "stitch and turn" method, the upper leather portion is stitched to the outsole on the side of the shoe. The outsole is typically a single molded unit and the upper leather portion is machine stitched thereto in a known manner. During initial construction, the stitching is accomplished in such a manner that the smooth or top side of the upper leather portion is facing downward and the rough side of the leather is facing upward when the upper leather portion is extended outward from the side of the shoe. After the upper leather portion has been stitched to the side of the outsole, it is turned over the top of the outsole so that the smooth side of the upper leather portion is reversed and faces upward, i.e., exterior, as in a finished shoe. However, the rough side of the leather then faces downward, i.e., toward the interior part of the shoe.

Many problems exist with conventional or traditional shoe construction of the prior art. For example, if the side stitch method is employed to construct the shoe, it is not possible to incorporate a firm counter component therein. This is because the firmness or stiffness of the counter component prevents the successful side stitching of the shoe by the stitching machinery. Further, use of the side stitching method of construction prevents proper waterproofing of the shoe at the interface of the upper leather portion and the outsole. The waterproofing problem exists because the machine stitch holes pass completely through each layer of shoe material, i.e., upper leather portion, counter component and inside lining, and thus cannot prevent the entry of moisture. The problems associated with the inability to provide a firm counter component and proper waterproofing of the shoe also exist with the "slip-lasted" and "stitch and turn" methods of shoe construction.

One prior art method of providing a firm counter component was to stitch the upper leather portion, counter component and inside fabric lining to the midsole. Thereafter, the midsole, filler and outsole were glued together. Waterproofing of the shoe could be achieved in this manner but this prior art method was time consuming and expensive. In an alternative prior art method, the counter component was installed between the upper leather portion and the inside fabric lining typically from above the shoe. The top ends of the upper leather portion and inside fabric lining were stitched together while the bottom ends were cemented to the bottom of the midsole. Then, the bottom of the midsole was glued to the outsole with the filler in between. In addition to bonding the components together, the cement also served as a means for closing the machine stitch holes. This assembly procedure required several steps and was time consuming and expensive because mistakes were common. Further, cemented components often separate after being successfully bonded together, for example, the separation of the upper leather portion from the outsole.

Another problem that exists in prior art methods of manufacturing shoes occurs, for example, with "stitch and turn" construction. In the "stitch and turn" shoe construction method, the insole sits on top of the outsole wall. The insole is typically comprised of soft material, . However, the outsole wall is comprised of hard material and is cube-shaped. Thus the corners of the outsole wall form 90 degree angles. Further, the insole is wider than the outsole wall and thus the ends of the insole extend past the corners of the outsole wall. When body weight is applied to the top of the insole via the foot, pressure is applied to those portions of the insole resting on and extending over the corners of the outsole wall. Consequently, the insole would break resulting in discomfort to the bottom of the wearer's foot. In an effort to overcome this problem, the thickness of the insole was increased to prevent the breakage. However, this solution reduced the available volume in the toe box of the shoe creating a fitting problem. Thus, the volume of the toe box had to be increased to solve the fitting problem. Unfortunately, increasing the volume of the toe box caused the shoe to become less attractive and unacceptable to consumers.

A traditional method of constructing shoes in the prior art is as follows. Initially, the upper leather portion was cut from leather parts and stitched together to form the style of shoe desired. Then, the upper leather portion was loosely placed over a "last" where the "last" is a model of the foot size for which the shoe is being constructed. Then a suitably sized midsole was placed underneath the "last". Thereafter, the upper leather portion was secured to the midsole by wrapping a small dimension of the leather of the upper leather portion underneath the midsole. This wrapping of the upper leather portion underneath the midsole was performed around the entire circumference of the midsole creating a ring of upper leather on the bottom of the midsole normally referred to as a "leather allowance". The ring of leather necessarily wrinkled at the toe and heel sections. At this point, the upper leather portion and the midsole with the ring of leather underneath were placed in a "toe lasting" machine to form the shape of the toe of the shoe. The ring of leather was then manually cemented to the bottom of the midsole.

The filler was utilized to fill the space formed between the midsole and the outsole caused by the ring of leather wrapped and cemented underneath the midsole. Thus, one function of the filler was to make the bottom of the shoe construction flat. The surface of the ring of leather underneath the midsole was roughened by sandpaper before additional cement was applied to attach the ring of leather to the midsole and the filler to ensure adequate bonding. After the ring of leather was cemented to the midsole and the filler, the bottom of the combined upper leather portion, midsole and filler was now a flat surface. The bottom flat surface of the combined upper leather portion, midsole and filler was then sanded in preparation to be mated and cemented with the top surface of an outsole. Additionally, the top surface of the outsole was also roughened as with sandpaper. An adhesive was then applied to the bottom flat surface (formed by the ring of leather, midsole and filler on the bottom of the upper leather portion) and also to the top surface of the outsole. The bottom flat surface of the upper leather portion was then mated with the top surface of the outsole. The entire shoe construction was then exposed to a heated environment to accelerate the bonding of the adhesive to the leather. The shoe was then placed into a foot-shaped holder and was subjected to a press that applied pressure to the top, bottom and sides of the shoe for a short period of time. The shoe was then permitted to sit so that the adhesive would cure.

In an alternative method, side stitch construction could be substituted for the cementing process. However, in the side stitch construction, the upper leather portion, counter component and the inner lining layer are each stitched together by the stitching machinery. This situation results in creating holes through each of the layers of the shoe construction. Consequently, because of the machine stitch holes, waterproofing of the shoe becomes a major problem.

Thus, there is a need in the art for a shoe having a simplified construction which provides an improved waterproofing capability by eliminating machine stitch holes that penetrate all of the layers of the shoe construction and which seals existing machine stitch holes with a waterproofing medium, and which eliminates breakage of the insole component, and which provides a firm heel portion by utilizing a rigid counter component installed between an upper leather layer and an inner lining layer, and provides shape to the shoe and structure that exhibits both shock absorption and stability, and which reduces manufacturing cost and production time and improves efficiency.

DISCLOSURE OF THE INVENTION

Briefly, and in general terms, the present invention provides a new and improved shoe having a simplified construction wherein the simplified construction can be employed for many different shoe designs including dress, casual and athletic shoes. The novel and non-obvious shoe having simplified construction exhibits an improved waterproofing capability by eliminating machine stitch holes that penetrate all of the layers of the shoe construction and by sealing existing machine stitch holes with a waterproofing medium, and which eliminates breakage of the insole component, and which provides a firm heel portion by utilizing a rigid counter component installed between an upper leather layer and an inner lining layer, and provides shape to the shoe and cushioning that provides both shock absorption and stability, while simultaneously reducing manufacturing cost and production time, and improving efficiency.

In a preferred embodiment, the inventive shoe having a simplified construction includes an upper leather layer having a top or upper edge and a bottom or lower edge. The upper leather layer is an outer layer and functions to enclose a foot of the individual wearing the shoe. An inner lining layer is positioned on the inside surface of the upper leather layer to provide support to the shoe and comfort to the foot. The inner lining layer is typically comprised of a synthetic material but can also be fashioned from leather. The inner lining layer is joined to the top or upper edge of the upper leather layer as by stitching. Thus, a pocket or gap exists between the inner lining layer and the upper leather layer. In order to provide a stiff heel section to the shoe, a rigid counter component typically comprised of plastic is positioned within the pocket or gap formed between the upper leather layer and the inner lining layer.

An outsole wall, which is typically U-shaped in the heel of the shoe and may extend around the entire perimeter of the shoe, interfaces with the upper leather layer. The outsole wall includes an upward extending top portion that is joined to the upper leather layer typically by stitching. The inner lining layer and the rigid counter component are not stitched to the outsole wall. The outsole wall includes a slanted inner surface in the heel portion of the shoe which forms a cavity that is shaped in the form of an inverted frustum. The outsole wall is comprised of a high density material such as hard rubber to provide stability to the structure of the shoe.

An insole is provided which functions to support the foot. The insole is shaped in the form of an inverted frustum, i.e., in the shape of an inverted cone having a flat top surface in lieu of a pointed apex. Thus, the insole includes a slanted outer surface that cooperates with the slanted inner surface of the outsole wall. Consequently, the inverted frustum-shaped insole is conveniently received into the inverted frustum-shaped cavity formed in the center of the outsole wall at the heel of the shoe. The insole is fashioned from a low density material such as soft rubber for providing shock absorption for improving the comfort of the shoe. An outsole typically comprised of high density material such as hard rubber is joined as by an adhesive to the bottom of both the outsole wall and the insole for completing the shoe construction and for contacting the ground surface.

The present invention is generally directed to a shoe having a simplified construction which is very versatile and can be employed for many different shoe designs. The simplified construction offers stability and shock absorption to the foot, improves waterproofing characteristics, and eliminates breakage of the insole component. In its most fundamental embodiment, the shoe having a simplified construction includes an upper layer having a top edge and a bottom edge for enclosing a foot in a shoe. An inner lining layer is joined to the top edge of the upper layer for providing comfort to the foot. A counter component is positioned between the upper layer and the inner lining layer for supporting a heel of the shoe. An outsole wall having a slanted inner surface forms a cavity within the outsole wall. Further, the outsole wall is joined to the bottom edge of the upper layer. An insole for supporting the foot is shaped to include a slanted outer surface so that the insole fits within the cavity formed within the outsole wall. Finally, an outsole is joined to a bottom of the outsole wall and the insole for contacting a ground surface.

In an alternative embodiment, the construction of the upper layer, inner lining layer and rigid counter component are identical to that of the preferred embodiment. However, in the alternative embodiment, an outsole wall is employed that includes a vertical inner surface for forming a cavity. The outsole wall is also joined to a bottom edge of the upper layer as by stitching. The cavity is rectangular-shaped and accommodates a rectangular-shaped midsole filler layer. An insole which is employed to support the foot is joined to a top surface of the midsole filler layer as with an adhesive. An outsole comprised of a high density material such as hard rubber is joined to the bottom of the outsole wall and the midsole filler layer as with an adhesive. The outsole is employed for completing the construction and making contact with the ground surface.

These and other objects and advantages of the present invention will become apparent from the following more detailed description, taken in conjunction with the accompanying drawings which illustrate the invention, by way of example.

BRIEF DESCRIPTION OF THE DRAWINGS

FIG. 1 is a perspective view of the rear side of a shoe having a simplified construction of the present invention showing an upper leather layer attached to an outsole and including a cutaway through the upper leather layer illustrating a counter component positioned between the upper leather layer and an inner lining layer.

FIG. 2 is a cross-sectional view of the lower rear side of the shoe having simplified construction taken along the line 2—2 of FIG. 1 showing an upper leather layer attached to a wedge-shaped outsole wall and to an inner lining layer via stitches with the upper leather layer and the inner lining layer being positioned below the wedge-shaped outsole wall.

FIG. 3 is a cross-sectional view of the rear side of the shoe taken along the line 3—3 of FIG. 1 showing a rigid plastic counter component positioned in between the upper leather layer and inner lining layer, the combination of the upper leather layer and inner lining layer with the rigid plastic counter component positioned there between being rotated upward to form the top of the shoe as shown in FIG. 1.

FIG. 4 is a cross-sectional view of the rear of the shoe of FIG. 1 taken essentially along line 2—2 of FIG. 1 showing an insole having a soft low density construction positioned above an outsole having a hard high density construction.

FIG. 9 is a cross-sectional view of the rear of the shoe of FIG. 1 taken essentially along line 6—6 of FIG. 1 showing an insole positioned above an outsole and having a midsole filler layer positioned there between.

DETAILED DESCRIPTION OF THE INVENTION

Figure 5:
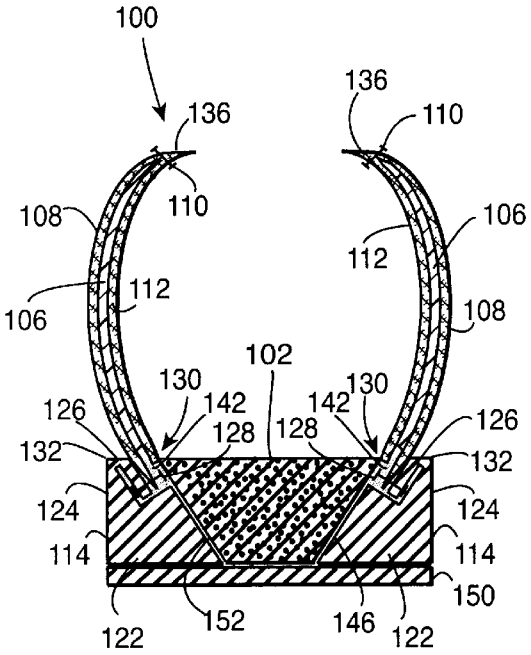
FIG. 5 is a cross-sectional view of the rear side of the shoe taken along the line 5—5 of FIG. 1 showing the components of the shoe having simplified construction in an assembled condition with the insole cemented within the wedge-shaped outsole wall, and the outsole being cemented to the bottom of the wedge-shaped outsole wall and the bottom of the insole.

The present invention is a shoe 100 having a simplified construction as shown in FIGS. 1–10 herein. The shoe 100 of the present invention can be employed for many different shoe designs including dress, casual and athletic shoes. The shoe 100 having the simplified construction exhibits an improved waterproofing capability by eliminating machine stitch holes that penetrate all of the layers of the shoe construction and by sealing existing machine stitch holes with a waterproofing medium. The simplified construction of the shoe 100 also eliminates the problem of breakage of an insole 102, provides a firm heel 104 by utilizing a rigid counter component 106, and provides both shock absorption and stability to the shoe 100. The simplified construction also provides foot support and shape to the shoe 100, reduces manufacturing cost and improves efficiency.

A preferred embodiment of the shoe 100 having a simplified construction is best shown in FIGS. 1–5. A rear view of shoe 100 is shown in FIG. 1 and is the view from which all of the cross-sectional views are taken. The shoe 100 shown in FIG. 1 exhibits the firm heel 104 located at the rear of the shoe 100. The outer surface of the shoe 100 referred to as an upper layer 108 is typically comprised of leather. Joined to the upper leather layer 108 by a first plurality of stitches 110 is an inner lining layer 112 shown best in FIGS. 2, 3 and 5 but also visible in the cutaway of FIG. 1. The rigid counter component 106 is clearly shown positioned between the upper leather layer 108 and the inner lining layer 112 in FIGS. 1–3 and 5. Located at a bottom of the shoe 100 is an outsole wall 114 that, in this example, extends around the periphery of the shoe 100. Also shown in FIG. 1 is a shoe tongue 116 and a portion of a set of shoe laces 118 employed to snug the shoe 100 about the foot. A facsimile which simulates the shape of a human foot is illustrated in FIG. 1 by a last 120 shown by dashed lines.

We will now direct our attention to FIGS. 2 and 3 which illustrate the relationship of the outsole wall 114 to the upper layer 108, inner lining layer 112 and the rigid counter component 106 positioned there between. In the preferred embodiment 100, the outsole wall 114 includes a bottom flat base surface 122 intersecting with a vertical wall 124 as is clearly shown in FIG. 2. At the top of the vertical wall 124 of the outsole wall 114 is a top extension portion 126. The top extension portion 126 is joined or fastened to the upper leather layer 108 by a second plurality of stitches 128. It is emphasized that only the upper leather portion 108 is connected, joined, or fastened to the top extension portion 126 by the plurality of stitches 128 as is clearly shown in FIGS. 2 and 3. The inner lining layer 112 is not stitched to the upper leather layer 108 or to the top extension portion 126 at a point 130 where the upper leather layer 108 and the top extension portion 126 are joined together. The top extension portion 126 includes a hinge 132 which facilitates folding the top extension portion 126 inward as shown in FIGS. 3 and 5 after the upper leather portion 108 has been joined to the top extension portion 126. Once folded inward, the top extension portion 126 is received by a shallow recess 134 as is best shown in FIG. 2.

The upper leather layer 108 includes a top edge 136 and a bottom edge 138 as is most clearly shown in FIG. 2. The inner lining layer 112 is joined to the upper leather layer 108 by being stitched to the top edge 136 of the upper layer 108 by the first plurality of stitches 110 as shown in FIGS. 2, 3 and 5. This construction provides comfort to the foot. However, the inner lining layer 112 is not joined to the upper leather layer 108 at the outsole wall 114 by the second plurality of stitches 128. Therefore, a space or pocket 140 exists between the upper leather layer 108 and the inner lining layer 112 as is shown exclusively in FIG. 2. It is this pocket 140 in which the rigid counter component 106 is inserted to provide the firm heel 104 to the shoe 100. Specifically, the rigid counter component 106 is inserted into the pocket 140 shown in FIG. 2 for the purpose of supporting the heel 104. Once inserted, the rigid counter component 106 occupies the pocket 140 as shown in FIGS. 3 and 5.

In FIG. 2, the upper leather layer 108 and the inner lining layer 112 are shown hanging downward with respect to the outsole wall 114 after the upper leather layer 108 has been stitched to the outsole wall 114. During assembly, it may be convenient to install the rigid counter component 106 into the pocket 140 at this stage. In order to prevent the rigid counter component 106 from escaping from the pocket 140, the point 130 at which the upper leather layer 108 is joined with the top extension portion 126 must be closed. This can be accomplished by the use of, for example, a waterproofing cement or adhesive 142 which can be used to seal the inner lining layer 112 to the bottom edge 138 of the upper leather layer 108 and to the top extension portion 126 of the outsole wall 114 as is shown in FIGS. 3 and 5. Thus, the inner lining layer 112 is glued between the insole 102 and the outsole wall 114. It is noted that the rigid counter component 106 is snugly captured within the pocket 140 between the upper layer 108 and the inner lining layer 112. Cements and adhesives 142 for use in the present invention between hard and soft rubber, polyurethane and other materials are well known in the shoe manufacturing art.

It is to be emphasized that in the present invention, there are no sewing machine stitch holes in the inner lining layer 112 or in the rigid counter component 106. The absence of machine stitch holes in the inner lining layer 112 and the rigid counter component 106 improves the waterproofing capability of the shoe 100. Further, the use of cement or adhesive 142 to seal the inner lining layer 112 to the bottom edge 138 of the upper leather layer 108 and to the top extension portion 126 of the outsole wall 114 closes the machine stitch holes (not shown) that are placed in the upper layer 108. Consequently, the waterproofing capability of the shoe 100 is improved. The cement or adhesive 142 actually used for bonding or sealing the various components together is selected based upon the materials that comprise the components. Notwithstanding, the cements or adhesives 142 selected are well known in the art.

After the cement 142 has set, the upper leather layer 108, the inner lining layer 112 and the rigid counter component 106 positioned there between in the pocket 140, are turned upward with respect to the outsole wall 114 as shown in FIGS. 3 and 5. The upward turning of these components orients the shoe construction for enclosing a foot of an individual in the shoe 100. When the upper leather layer 108, inner lining layer 112 and the rigid counter component 106 are turned upward with respect to the outsole wall 114, the top extension portion 126 is rotated about the hinge 132 of the outsole wall 114. The top extension portion 126 is rotated until it is seated within the shallow recess 134 of the outsole wall 114. Once positioned within the shallow recess 134, the top extension portion 126 is held in place with the cement or adhesive 142.

Thus, the sewing machine stitch holes (not shown) that are formed in the upper layer 108 have now been isolated and sealed by the cement 142 within the shallow recess 134 inside the vertical wall 124 of the outsole wall 114. Consequently, the waterproofing capability of the shoe 100 of the present invention is further improved over that of the prior art. In the preferred embodiment, the upper layer 108 is preferable comprised of leather, while the inner lining layer 112 is comprised of a synthetic material or alternately, of leather. The synthetic material which forms the inner lining layer 112 is intended to provide comfort to the foot. The rigid counter component 106 intended to support the heel 104 of the shoe 100 can be fashioned from a rigid plastic material such as polyurethane.

We will now continue the description of the outsole wall 114. The outsole wall 114 comprises a U-shaped construction as is clearly indicated in the rear view of FIG. 1. The outsole wall 114 is comprised of a high density material such as hard rubber to provide stability to the structure of the shoe 100. A feature of the present invention is that the outsole wall 114 exhibits a slanted inner surface 146 as is clearly shown in FIGS. 2, 3 and 5. The slanted inner surface 146 is positioned between the shallow recess 134 and the bottom flat base surface 122 as is best shown in FIG. 2. The slanted inner surface 146 is maintained at a fixed angle (i.e., constant slope) in the preferred embodiment. In the preferred embodiment, the fixed angle can be within the range of from about (25-to-55) degrees. The slanted inner surface 146 of the outsole wall 114 forms a cavity 148 that exhibits the outline shape of an inverted frustum. The cavity 148 interfaces with the insole 102 as will now be described. The insole 102 and an outsole 150 are each shown in relative position to one another in FIG. 4.

The insole 102 serves to support the foot, i.e., the insole 102 is positioned so that the foot would be directly located on top of the insole 102 as is best shown in FIG. 5. The insole 102 exhibits the geometric configuration of an inverted frustum, i.e., in the shape of an inverted solid cone or pyramid between two parallel lines cutting the solid having a flat top surface in lieu of a pointed apex. Further, the insole 102 includes a slanted outer surface 152 as is best shown in FIG. 4. The slanted outer surface 152 of the insole 102 is also maintained at a fixed angle in the preferred embodiment. The fixed angle can vary within the range of from about (25-to-55) degrees. The range of angles of the slanted outer surface 152 of the insole 102 is consistent with the range of angles of the slanted inner surface 146 of the outsole wall 114. Consequently, the inverted frustum-shaped insole 102 is conveniently received within the inverted frustum-shaped cavity 148 formed in the center of the outsole wall 114 at the heel 104 of the shoe 100. Under these circumstances, the slanted outer surface 152 of the insole 102 is in physical contact with the slanted inner surface 146 of the outsole wall 114 as is best shown in FIG. 5. The insole 102 is fashioned from a low density material such as soft rubber for providing shock absorption to the foot which improves the comfort of the shoe 100. The insole 102 is fitted within the cavity 148 of the outsole wall 114 and can be joined permanently thereto by utilizing the cement or adhesive 142.

The outsole 150 is shown in FIGS. 4 and 5 and is typically comprised of high density material such as hard rubber (similar to that of the outsole wall 114). However, other suitable materials can also be utilized. The outsole 150 is joined to the bottom of both the outsole wall 114 and the insole 102 as is clearly shown in FIG. 5. The cement or adhesive 142 is useful in joining the components, i.e., the outsole wall 114 and the insole 102, for completing the construction of the shoe 100. Additionally, the outsole 150 serves to contact a ground or floor surface. Each of the components of the shoe 100 is shown in an assembled state in FIG. 5.

The construction of the shoe 100 shown in FIG. 5 provides several distinct advantages over conventional shoe designs of the prior art. Initially, the outsole wall 114 and the outsole 150 bonded thereto are each comprised of a high density material such as hard rubber. The high density material provides stability and durable wear characteristics to the outer structure of the shoe 100. Conversely, the insole 102 joined to both the outsole wall 114 and the outsole 150 is comprised of a low density material such as soft rubber. Consequently, the construction of the shoe 100 simultaneously provides durable wear characteristics in combination with comfort features. Another main advantage of the construction of the shoe 100 is directed to the breakage of the soft insole of prior art shoe designs. The problem of breakage of the insole comprised of soft material while resting on a cube-shaped outsole wall comprised of hard material when foot pressure was applied is now avoided. This problem is avoided because the outsole wall 114 of the present invention is not cube-shaped and does not have 90 degree angles. Thus, in the present invention, the insole 102 is not subjected to such abuse. The slanted outer surface 152 of the insole 102 cooperates with the slanted inner surface 146 of the cavity 148 of the outsole wall 114. Consequently, foot pressure applied to the insole 102 does not result in damage thereto.

An alternative embodiment of the shoe having simplified construction of the present invention is shown in FIGS. 6–10 and is hereinafter referred to by the identification number 200. Each of the components appearing in the alternative embodiment 200 that correspond in structure and function to those components appearing in the preferred embodiment 100 is identified by the corresponding number of the 200 series.

The construction of the alternative embodiment 200 of the shoe having simplified construction is very similar to the construction of the preferred embodiment 100. However, specific structural modifications appearing in the alternative embodiment 200 of the present invention are directed to the shape of an insole 202 and an outsole wall 214, and also the addition of a midsole (filler) layer 260, each clearly shown in FIG. 10. Notwithstanding, many features of the shoe 200 of the alternative embodiment are duplicate to those features of the shoe 100 of the preferred embodiment. For example, the shoe 200 includes a firm heel 204, a rigid counter component 206, an upper layer 208 joined to the outsole wall 214 by a second plurality of stitches 210, and an inner lining layer 212. The construction of the combination of the rigid counter component 206, upper layer 208, and inner lining layer 212 of the shoe 200 is the same as that described in the shoe 100 of the preferred embodiment.

Figure 6:
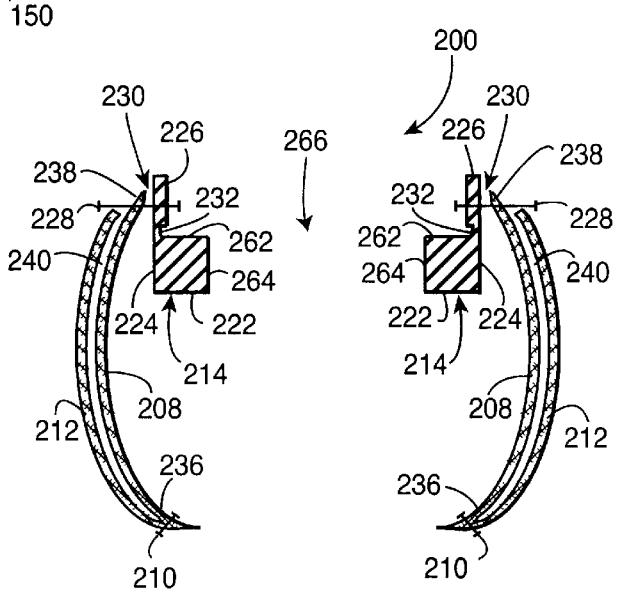
FIG. 6 is a cross-sectional view of an alterative embodiment of the shoe having simplified construction taken along the line 6—6 of FIG. 1 showing an upper leather layer attached to a block-shaped outsole wall and to an inner lining layer via stitches with the upper leather layer and the inner lining layer being positioned below the block-shaped outsole wall.
Figure 7:
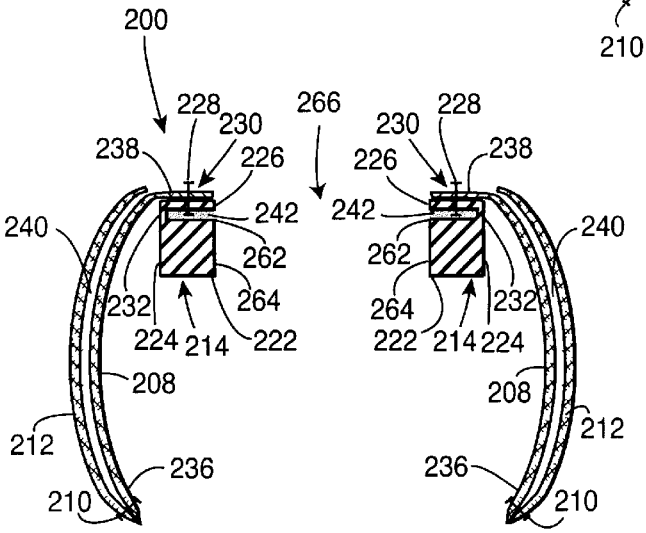
FIG. 7 is a cross-sectional view of the rear side of the shoe taken essentially along the same line as that of FIG. 6 showing the top extension portion of the block-shaped outsole wall cemented to the block-shaped outsole wall, and the upper leather layer and the inner lining layer being stitched together and positioned below the block-shaped outsole wall.
Figure 8:
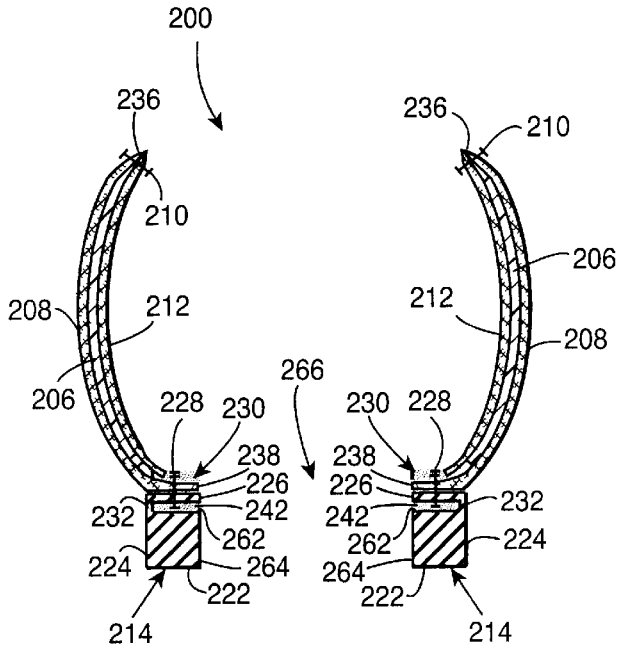
FIG. 8 is a cross-sectional view of the rear side of the shoe taken along the line 8—8 of FIG. 1 showing a rigid plastic counter component positioned in between the upper leather layer and inner lining layer, the combination of the upper leather layer and inner lining layer with the plastic counter component positioned there between being rotated upward to form the top of the shoe as shown in FIG. 1.
Figure 10:
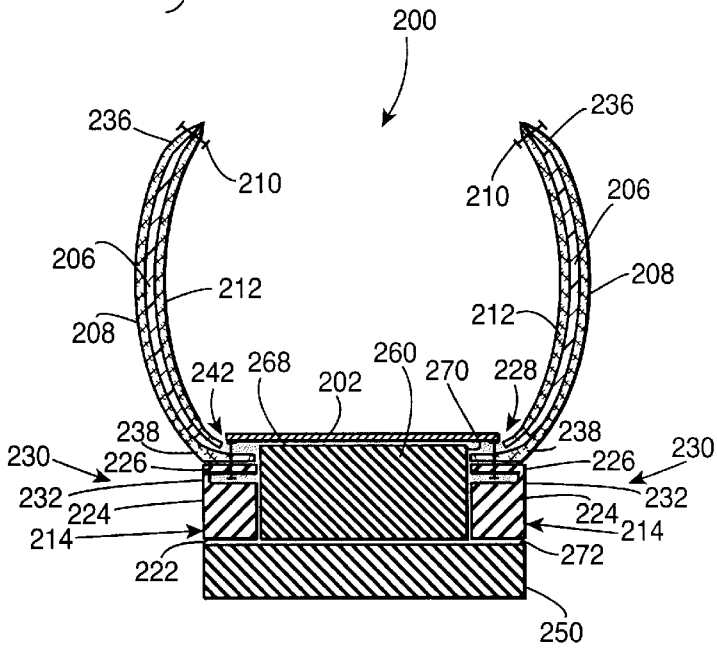
FIG. 10 is a cross-sectional view of the rear side of the shoe taken essentially along the line 8—8 of FIG. 1 showing the components of the shoe having simplified construction in an assembled condition with the insole cemented to the top of the midsole filler layer and to the upper leather and inner lining layers, the midsole filler layer being positioned within the block-shaped outsole wall, the midsole filler layer and the block-shaped outsole wall being cemented to the top of the outsole.

We will now direct our attention to FIGS. 6, 7 and 8 which illustrate the relationship of the outsole wall 214 to the upper layer 208, inner lining layer 212 and the rigid counter component 206 positioned there between. In the alternative embodiment 200, the outsole wall 214 includes a bottom flat base surface 222 intersecting with a vertical wall 224 as is clearly shown in FIG. 6. At the top of the vertical wall 224 of the outsole wall 214 is a top extension portion 226. The top extension portion 226 is joined or fastened to the upper leather layer 208 by a second plurality of stitches 228. It is emphasized that only the upper leather portion 208 is connected, joined, or fastened to the top extension portion 226 by the plurality of stitches 228 as is clearly shown in FIGS. 6 and 7. The inner lining layer 212 is not stitched to the upper leather layer 208 or to the top extension portion 226 at a point 230 where the upper leather layer 208 and the top extension portion 226 are joined together. The top extension portion 226 includes a hinge 232 which facilitates folding the top extension portion 226 downward as shown in FIGS. 7, 8 and 10 after the upper leather portion 208 has been joined to the top extension portion 226 with the second plurality of stitches 228.

The upper leather layer 208 includes a top edge 236 and a bottom edge 238 as is most clearly shown in FIGS. 6 and 7. The inner lining layer 212 is joined to the upper leather layer 208 by being stitched to the top edge 236 of the upper layer 208 by the second plurality of stitches 210 as shown in FIGS. 6, 7, 8 and 10. This construction provides comfort to the foot. However, the inner lining layer 212 is not joined to the upper leather layer 208 at the outsole wall 214 by the second plurality of stitches 228 as is clearly shown in FIGS. 6 and 7. Therefore, a space or pocket 240 exists between the upper leather layer 208 and the inner lining layer 212 as is shown exclusively in FIGS. 6 and 7. It is this pocket 240 in which the rigid counter component 206 is inserted to provide the firm heel to the shoe 200. Specifically, the rigid counter component 206 is inserted into the pocket 240 between the upper layer 208 and the inner lining layer 212 shown in FIGS. 6 and 7 for the purpose of supporting the heel of the shoe 200. Once inserted, the rigid counter component 206 occupies the pocket 240 as shown in FIGS. 8 and 10.

In FIGS. 6 and 7, the upper leather layer 208 and the inner lining layer 212 are shown hanging downward with respect to the outsole wall 214 after the upper leather layer 208 has been stitched to the outsole wall 214. During assembly, it may be convenient to install the rigid counter component 206 into the pocket 240 at this stage. In order to prevent the rigid counter component 206 from escaping from the pocket 240, the point 230 at which the upper leather layer 208 is joined with the top extension portion 226 must be closed. This can be accomplished by the use of, for example, a waterproofing cement or adhesive 242 which can be used to seal the inner lining layer 212 to the bottom edge 238 of the upper leather layer 208 and to the top extension portion 226 of the outsole wall 214 as is shown in FIGS. 7, 8 and 10. Thus, the inner lining layer 212 is glued between the insole 202 and the top extension portion 226 of the outsole wall 214. It is noted that the rigid counter component 206 is snugly captured within the pocket 240 between the upper layer 208 and the inner lining layer 212. Cements and adhesives 242 for use in the present invention between hard and soft rubber, polyurethane and other materials are well known in the shoe manufacturing art.

It is to be emphasized that in the present invention, there are no sewing machine stitch holes in the inner lining layer 212 or in the rigid counter component 206. The absence of machine stitch holes in the inner lining layer 212 and the rigid counter component 206 improves the waterproofing capability of the shoe 200. Further, the use of cement or adhesive 242 to seal the inner lining layer 212 to the bottom edge 238 of the upper leather layer 208 and to the top extension portion 226 of the outsole wall 214 closes the machine stitch holes (not shown) that are placed in the upper layer 208. Consequently, the waterproofing capability of the shoe 200 is improved. The cement or adhesive 242 actually used for bonding or sealing the various components together is selected based upon the materials that comprise the components. Notwithstanding, the cements or adhesives 242 selected are well known in the art.

After the cement 242 has set, the upper leather layer 208, the inner lining layer 212 and the rigid counter component 206 positioned there between in the pocket 240, are turned upward with respect to the outsole wall 214 as shown in FIGS. 8 and 10. The upward turning of these components orients the shoe construction for enclosing a foot of an individual in the shoe 200. When the upper leather layer 208, inner lining layer 212 and the rigid counter component 206 are turned upward with respect to the outsole wall 214, the top extension portion 226 is rotated about the hinge 232 of the outsole wall 214. The top extension portion 226 is rotated until it is seated on a top surface 262 of the outsole wall 214 best shown in FIG. 6. Once positioned on the top surface 262 of the outsole wall 214 as shown in FIG. 7, the top extension portion 226 is held in place with the cement or adhesive 242. Thus, the sewing machine stitch holes (not shown) that are formed in the upper layer 208 have now been isolated and sealed by the cement 242 on the top surface 262 of the outsole wall 214. Consequently, the waterproofing capability of the shoe 200 of the present invention is further improved over that of the prior art. In the alternative embodiment, the upper layer 208 is preferable comprised of leather, while the inner lining layer 212 is comprised of a synthetic material or alternately, of leather. The synthetic material which forms the inner lining layer 212 is intended to provide comfort to the foot. The rigid counter component 206, intended to support the heel of the shoe 200, can be fashioned from a rigid plastic material such as polyurethane.

We will now continue the description of the outsole wall 214 of the alternative embodiment of the shoe 200. The outsole wall 214 comprises a U-shaped construction as is clearly indicated in the rear view of FIG. 1. The outsole wall 214 is comprised of a high density material such as hard rubber to provide stability to the structure of the shoe 200. A feature of the alternative embodiment of the present invention is that the outsole wall 214 exhibits a vertical inner surface 264 as is clearly shown in FIGS. 6, 7 and 8. The vertical inner surface 264 is positioned between the hinge 232 and the bottom flat base surface 222 as is best shown in FIG. 6. In the alternative embodiment, the vertical inner surface 264 of the outsole wall 214 is at right angles to an outsole 250 as is best shown in FIG. 10. The vertical inner surface 264 of the outsole wall 214 forms a cavity 266 that exhibits a rectangular-shaped outline. The cavity 266 interfaces with the insole 202 and the midsole (filler) layer 260 as will be described herein below. The insole 202, midsole (filler) layer 260 and the outsole 250 are each shown in relative position to one another in FIG. 9.

Figure 9:
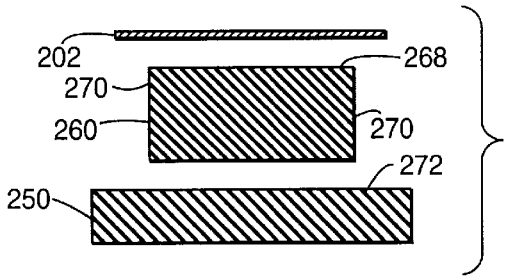

The insole 202 serves to support the foot, i.e., the insole 202 is positioned so that the foot would be located directly on top of the insole 202 during use of the shoe 200 as is best shown in FIG. 10. The insole 202 exhibits the geometric configuration of a narrow layer, for example, a thin cushioned disk formed in the shape of the heel of the shoe 200 which can be flexible to avoid breakage as is best shown in FIGS. 9 and 10. The insole 202 can be fashioned from any suitable low density material known in the art including soft rubber or other durable cushioned materials for providing shock absorption to the foot which improves the comfort of the shoe 200. The insole 202 is joined to a top surface 268 of the midsole (filler) layer 260 (best shown in FIG. 9) and to the bottom edge 238 of the upper layer 208 by the cement or adhesive 242 as shown in FIG. 10.

The midsole (filler) layer 260 includes a vertical outer surface 270 that is orthogonal (i.e., at right angles) to the top surface 268 thereof resulting in a rectangular-shaped body as is best shown in FIG. 9. Thus, the orthogonal shape of the midsole (filler) layer 260 is consistent with the vertical inner surface 264 of the outsole wall 214 (which is also at right angles to the outsole 250) as shown in FIG. 10. Consequently, the rectangular-shaped midsole (filler) layer 260 is conveniently received within the rectangular-shaped cavity 266 formed within the center of the outsole wall 214 at the heel of the shoe 200 as shown in FIG. 10. The midsole (filler) layer 260 can be permanently affixed within the cavity 266 of the outsole wall 214 by utilizing the cement or adhesive 242. Thus, the midsole (filler) layer 260 is joined, as with cement 242, to the insole 202 at the top surface 268 of the midsole (filler) layer 260, and at the vertical inner surface 264 of the outsole wall 214. Typically, the midsole (filler) layer 260 is not as wide as the insole 202 or the outsole 250 as is shown in FIG. 10. The midsole (filler) layer 260 can be comprised of scrap material including leather or ethylene vinyl acetate commonly referred to as ("EVA").

The outsole 250 is shown in FIGS. 9 and 10 and is typically comprised of high density material such as hard rubber (similar to that of the outsole wall 214). However, other suitable materials can also be utilized. The outsole 250 is joined to the bottom of both the outsole wall 214 and the midsole (filler) layer 260 at an outsole top surface 272 as is clearly shown in FIGS. 9 and 10. The cement or adhesive 242 is useful in joining the components, i.e., the outsole wall 214 to the outsole 250, and the midsole (filler) layer 260 to the outsole 250, for completing the construction of the shoe 200. Additionally, the outsole 250 serves to contact a ground or floor surface. Each of the components of the shoe 200 is shown in an assembled state in FIG. 10.

The present invention provides novel advantages over other shoe constructions known in the art. A main advantage of the shoe 100 having the simplified construction of the present invention is that it provides improved waterproofing capability by eliminating machine stitch holes that penetrate all of the layers of the shoe construction and by sealing existing machine stitch holes with a waterproofing medium such as cement 142. Another main advantage of the shoe 100 is that the design of the outsole wall 114 and the insole 102 eliminates breakage of the insole 102 when the user steps down on the shoe 100. Additionally, a firm heel 104 is provided by utilizing a rigid counter component 106 which is installed between the upper leather layer 108 and the inner lining layer 112. The rigid counter component 106 also provides shape to the shoe 100. The insole 102 comprised of a low density material provides cushioning and shock absorption while the outsole wall 114 and outsole 150 each comprised of a high density material provides stability to the foot. The complexity of the construction of the shoe 100 is reduced compared to conventional methods. In addition, the simplified construction also provides improved foot support and shape to the shoe 100, reduces manufacturing cost and production time, and improves efficiency.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention.

Accordingly,

What is claimed is:

1. A shoe having a simplified construction comprising:

an upper layer having a top edge and a bottom edge for enclosing a foot in a shoe;

an inner lining layer joined to said top edge of said upper layer for providing comfort to said foot;

a counter component positioned between said upper layer and said inner lining layer for supporting a heel of said shoe;

an outsole wall having a slanted inner surface for forming a cavity, said outsole wall being joined to said bottom edge of said upper layer;

an insole for supporting said foot and having a slanted outer surface for fitting within said cavity, said slanted outer surface of said insole in physical contact with said slanted inner surface of said outsole wall; and an outsole joined to a bottom of said outsole wall and said insole for contacting a ground surface.

2. The shoe of claim 1 wherein said upper layer is comprised of leather.

3. The shoe of claim 1 wherein said inner lining layer is comprised of a synthetic material.

4. The shoe of claim 1 wherein said counter component is comprised of rigid plastic.

5. The shoe of claim 1 wherein said outsole wall is U-shaped.

6. The shoe of claim 1 wherein said outsole wall includes a top extension portion for joining said outsole wall to said upper layer.

7. The shoe of claim 6 wherein said top extension portion is joined to said upper layer by a plurality of stitches.

8. The shoe of claim 1 wherein said outsole wall is comprised of high density material.

9. The shoe of claim 1 wherein said insole is comprised of a low density material.

10. The shoe of claim 1 wherein said outsole is comprised of high density material.

11. The shoe of claim 1 wherein said outsole is joined to said bottom of said outsole wall and said insole by an adhesive.

12. A shoe having a simplified construction comprising:

an upper layer having a top edge and a bottom edge for enclosing a foot in a shoe;

an inner lining layer joined to said top edge of said upper layer for providing comfort to said foot;

a counter component positioned between said upper layer and said inner lining layer for supporting a heel of said shoe;

an outsole wall having a slanted inner surface for forming a cavity, said outsole wall being comprised of a high density material and joined to said bottom edge of said upper layer;

an insole having a slanted outer surface for fitting within said cavity and comprised of a low density material for cushioning said foot, said slanted outer surface of said insole in physical contact with said slanted inner surface of said outsole wall; and an outsole joined to a bottom of said outsole wall and said insole for contacting a ground surface.

13. The shoe of claim 12 wherein said outsole is comprised of a high density material.

* * * * *